US005603579A

United States Patent [19]

Narita et al.

[11] Patent Number: 5,603,579

[45] Date of Patent: Feb. 18, 1997

[54] PAPER TRANSFER APPARATUS AND PRINTER USING THE SAME

[75] Inventors: Hiroshi Narita; Hiroaki Hosomi; Tsutomu Momose; Masahiko Yamada, all of Nagano, Japan

[73] Assignee: Seiko Epson Corporation, Tokyo, Japan

[21] Appl. No.: 379,743

[22] Filed: Jan. 27, 1995

[30] Foreign Application Priority Data

Jan. 31, 1994 [JP] Japan ..... 6-028802

[51] Int. Cl.[6] ..... B41J 15/04

[52] U.S. Cl. ..... 400/616.3; 400/616.1; 226/82

[58] Field of Search ..... 400/579, 616, 400/616.1, 616.2, 616.3; 226/76, 79, 82

[56] References Cited

U.S. PATENT DOCUMENTS

| | | | |
|---|---|---|---|
| 4,732,501 | 3/1988 | Angst et al. | 400/613.2 |
| 5,064,305 | 11/1991 | Matsuda et al. | 400/616.3 |
| 5,139,190 | 8/1992 | Ferguson | 400/616.1 |

FOREIGN PATENT DOCUMENTS

| | | | |
|---|---|---|---|
| 59-178276 | 10/1984 | Japan | 400/579 |
| 1-182075 | 7/1989 | Japan | 400/616 |
| 2-185470 | 7/1990 | Japan | 400/616 |
| 3-104675 | 5/1991 | Japan | 400/616 |

*Primary Examiner*—Christopher A. Bennett

*Attorney, Agent, or Firm*—Sughrue, Mion, Zinn, Macpeak & Seas

[57] ABSTRACT

A paper transfer apparatus for transferring a recording paper by rotating a first and second sprocket wheels having a plurality of pins to be engaged with sprocket holes disposed on both sides of the recording paper comprising a first paper guide for forming a paper transfer path having a first intersection with a rotational locus of the tip of the pins mounted on the first sprocket wheel, and a second paper guide for forming a paper transfer path having a second intersection with a rotational locus of the tip of the pins mounted on the second sprocket wheel, the first intersection being placed upstream in a paper transfer direction from the second intersection.

18 Claims, 7 Drawing Sheets

PAPER TRANSFER APPARATUS AND PRINTER USING THE SAME

BACKGROUND OF THE INVENTION

The invention relates mainly to a paper transfer apparatus for small-sized printers.

Printers used for cash registers and the like usually use a continuous paper having such sprocket holes to help feed the continuous paper on both sides thereof, and sequentially feed the continuous paper into the platen by causing pins of sprocket wheels to engage these sprocket holes.

It is, therefore, required that the continuous paper .be introduced correctly to allow the pins of the sprocket wheels to correctly engage the sprocket holes on both left and right sides. However, in reality, the paper, which is not rigid enough, cannot be introduced correctly, which in turn causes the paper to be transferred with only the sprocket holes on one side engaged with the corresponding pins, thus often causing paper transferring errors such as jamming of the paper.

SUMMARY OF THE INVENTION

The invention has been made in view of the aforementioned problem. Accordingly, the object of the invention is to provide a novel paper transfer apparatus that can permit reliable engagement of a continuous paper with the sprocket wheels.

To achieve the aforementioned object, the paper transfer apparatus of the invention comprises a first paper guide means for forming a paper transferring path having a first intersection with a rotational locus of the tip of the sprocket pins mounted on a first sprocket wheel and second paper guide means for forming a paper transferring path having a second intersection with a rotational locus of the tip of the sprocket pins mounted on a second sprocket wheel, the first intersection being placed upstream in a paper transferring direction from the second intersection.

DETAILED DESCRIPTION OF THE PREFERRED EMBODIMENTS

An embodiment of the invention will now be described with reference to the drawings.

The drawings show a paper transfer apparatus, which is the embodiment of the invention. A construction of the paper transfer apparatus will be described first with reference to FIGS. 5 and 7.

Figure 5:
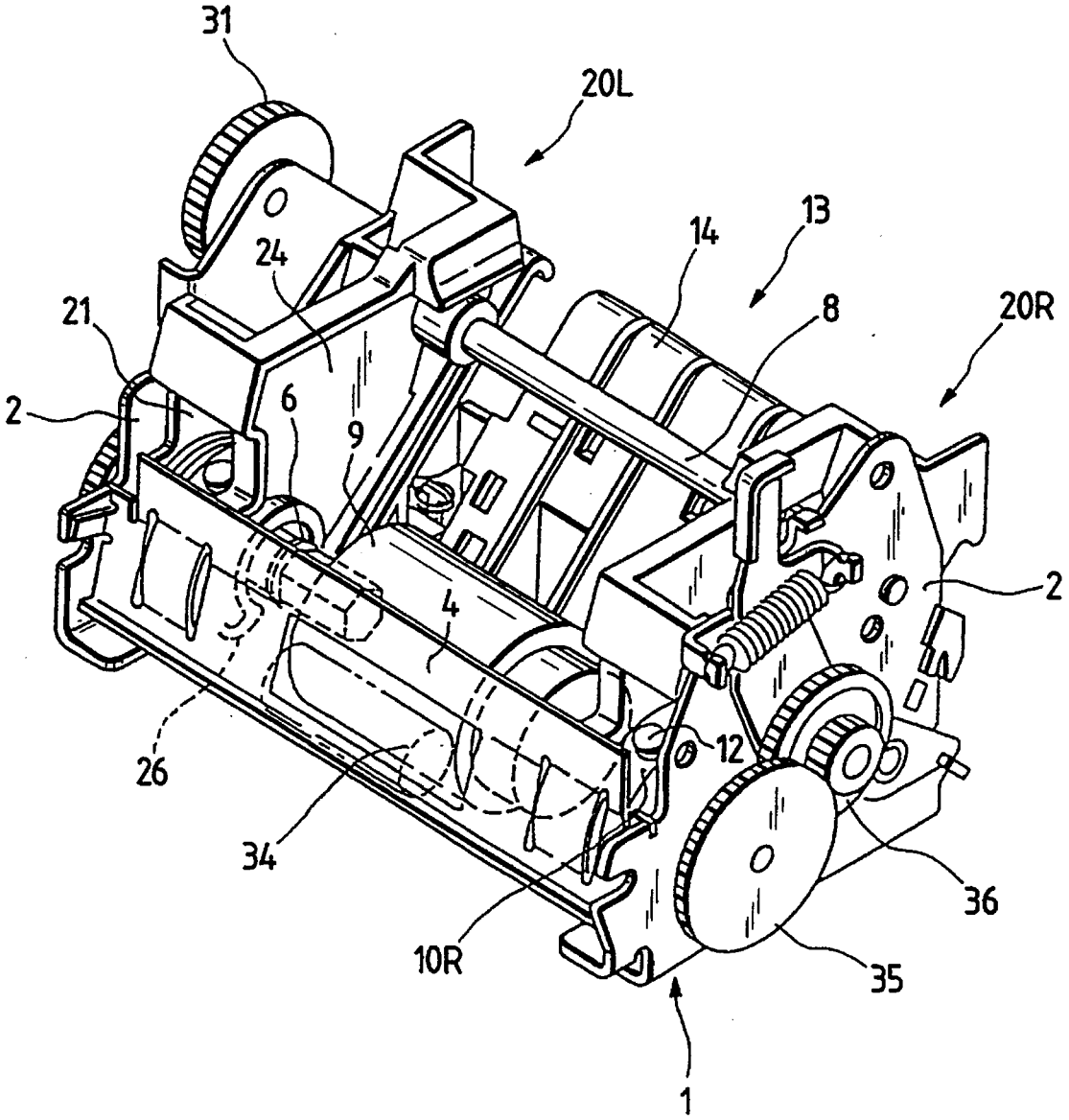
FIG. 5 is a perspective view showing the same paper transfer apparatus from a platen side.
Figure 7:
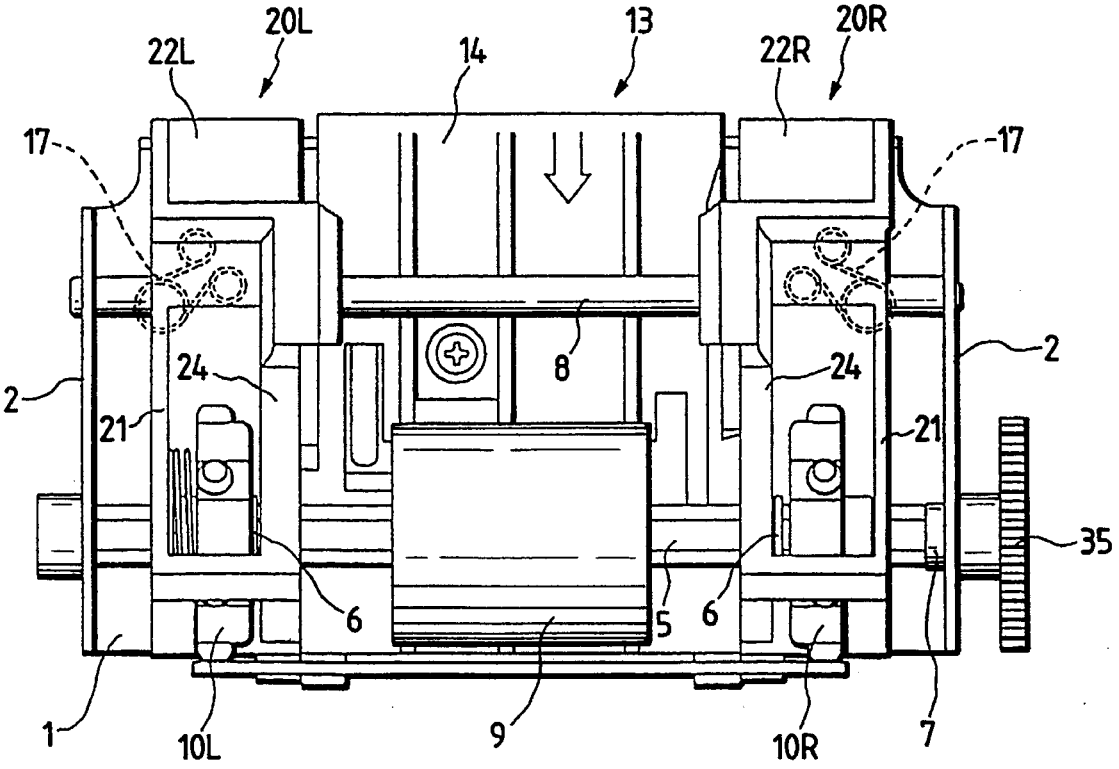
FIG. 7 is a plan view showing the same paper transfer apparatus from top.

In FIGS. 5 and 7, a sub-frame denoted by reference numeral 1 contains all the members cooperating for paper transfer as a single unit. The sub-frame 1 is secured to a printer main body (not shown) so that a platen 4 faces a print head (not shown).

Both lateral plates 2, 2 of the sub-frame 1 support a paper transfer shaft 5, which is polygonal in cross-section, nearly under the platen 4. The paper transfer shaft 5 is rotated by a stepping motor (not shown) through an intermediate gear 36, which is meshed with a gear 35 secured to one end of the paper transfer shaft 5. A guide roller 9 is secured to the middle of the paper transfer shaft 5. A pair of sprocket wheels 10L, 10R are provided to both sides of the guide roller 9. The sprocket wheels are mounted slidably in the axial direction so as to line up with the left and right sprocket holes of a fan-fold papers, and are integrally rotatable with the guide roller 9. As will be mentioned later, when the sprocket wheels are not used, the guide roller 9 functions as a paper transfer roller.

Figure 6:
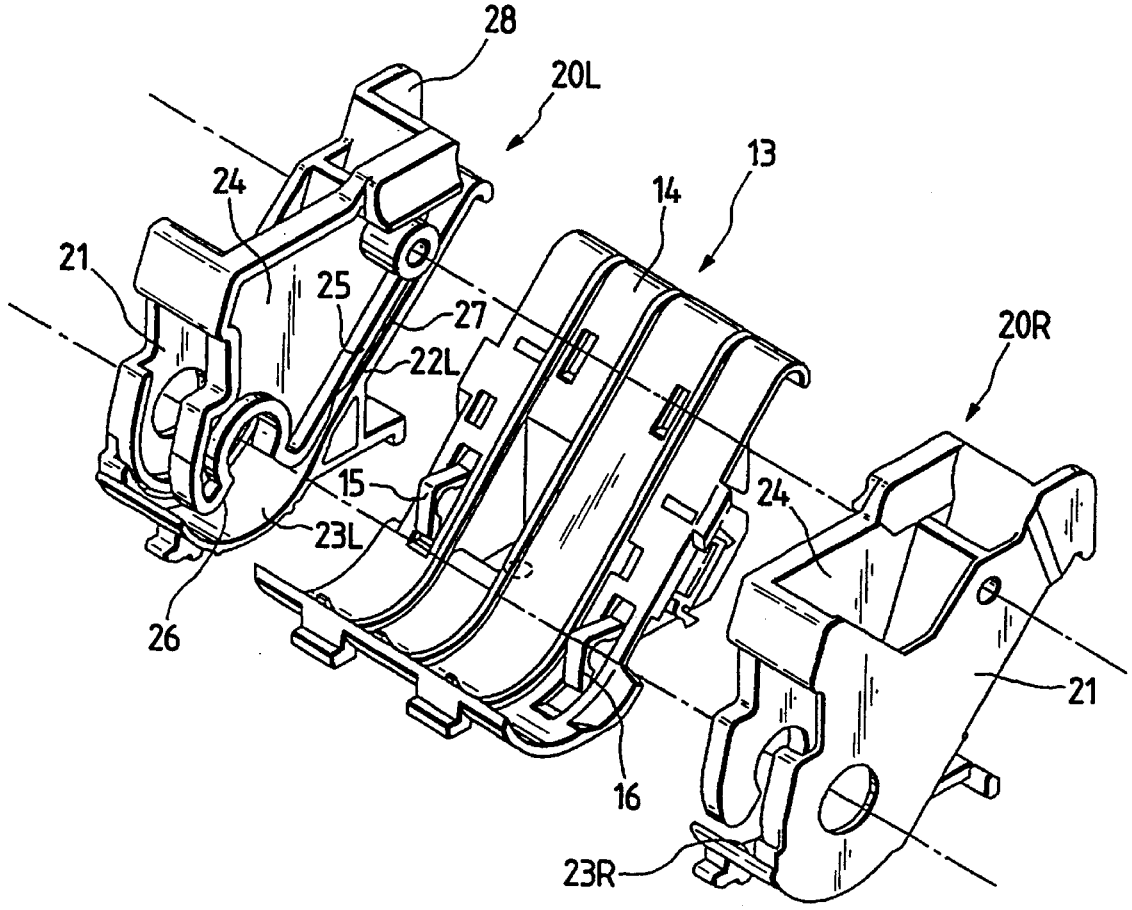
FIG. 6 is a perspective view showing paper guide members in exploded form.

The sub-frame 1 has a fixed paper guide member 13 that is fixed integrally therewith in the middle of the rear side thereof. The fixed paper guide member 13 serves to transfer the fan-fold paper toward the sprocket wheels 10L, 10R and the guide roller 9. As shown in FIG. 6, paper detecting sensor arm 15 are retractably mounted on the fixed paper guide member 13. The paper detecting sensor arm 15 detect presence of a paper at a position immediately before the leading end of the paper is inserted into the sprocket wheels 10L, 10R.

A paper detecting sensor arm 16 is provided at the position where a roll paper, which is not provided with a sprocket hole, reaches the guide roller 9 in order to obtain a rotation start timing of the guide roller 9 when the roll paper is inserted to be transferred.

Further, if the latter paper detecting sensor is placed immediately behind the engaging point of the fan-fold paper with the sprocket wheel pins in the right hand movable paper guide member 20R, it can be detected whether or not the fan-fold paper is fed successfully. That is, when the fan-fold paper fed by the left hand sprocket wheel 10L has, in turn, been fed by the right hand sprocket wheel 10R with sprocket wheel pins engaged with the sprocket holes of the fan-fold paper, the paper detecting sensor arm 16 can detect the fan-fold paper. On the other hand, when the fan-fold paper has failed to be fed into and to be engaged with the sprocket wheel pins, the paper detecting sensor arm 16 cannot detect the fan-fold paper. Accordingly, the fan-fold paper transferred by the left hand sprocket wheel 10L is stopped when the paper detection sensor provided with the arm 16 does not output a detection signal within a prescribed period after the left hand sprocket wheel 10L is started to transfer the fan-fold paper. Thus, a paper jamming in an engage guide section of the movable paper guide means, which guides the fan-fold paper to be engaged with the sprocket wheel, can be prevented.

A pair of movable paper guide members 20L, 20R are disposed so as to be movable in the paper width direction while guided by both a rod 8 and a horizontally extending bent edge (not shown) which is formed by bending an edge of the sub-frame 1 under the platen 4. The rod 8 bridges between both lateral plates 2, 2 of the sub-frame 1. The toggling operation of bistable springs 17, 17, whose ends are fixed at the movable paper guide members 20L and 20R and a bottom plate 3 of the sub-frame 1, stably positions the movable paper guide members 20L and 20R at a position corresponding to 3 inch wide papers or a position corresponding to 3.5 inch wide papers.

These movable paper guide members 20L, 20R in the invention cause pins 12, 12 of the sprocket wheels 10L, 10R to accurately be engaged with sprocket holes h arranged on both sides of a fan-fold paper, the sprocket holes serving to help transfer the fan-fold paper. Each movable paper guide member 20R (20L) holds the corresponding sprocket wheel 10R (10L) mounted slidably on the paper transfer shaft 5 between a outer and inner plate 21, 24 arranged around the paper transfer shaft 5 so as to give play in the axial direction. When the movable paper guide members 20R and 20L are moved inward to be set for the 3 inch fan-fold paper, stopper rings 6 provided on the paper transfer shaft 5 are caused to enter into the movable paper guide members 20R and 20L through the inner plates 24 so that the stopper rings 6 abut on the inner surface of the sprocket wheels 10, which in turn causes the pins 12 to meet with the sprocket holes h of the fan-fold paper as shown in FIG. 7. In addition, when the movable paper guide members 20R and 20L are moved outward to be set for a 3.5 inch fan-fold paper, a larger-diameter portion 7 arranged on an outer end of the paper transfer shaft 5 is caused to enter into the movable paper guide member 20 through the outer plates 21 so that the larger-diameter portion 7 abuts on the inner surface of the corresponding sprocket wheel 10, which in turn causes the pins 12 to meet with the sprocket holes of the fan-fold paper as shown in FIG. 7.

Further, as shown in FIG. 6, the outer and inner plates 21, 24 have cross plates 22L and 22R, 25 at lower edges thereof. The cross plates 22L and 22R, 25 serve to form slits 27L and 27R which guide both sides of the fan-fold paper into the sprocket wheels 10L, 10R. Inner surfaces 28, namely the inner surfaces of both outer plates partitioned by the cross plates 22L and 22R, 25 function as regulating surfaces for correcting the setting place of and aligning the fan-fold paper in the paper width direction by supporting both side edges of the fan-fold paper slidably on the inner surfaces 28.

The upper cross plate 25 that extends from the lower edge of the inner plate 24 to the inner surface of the outer plate 21 has a lower end thereof 26 widely opened in the vicinity of the paper transfer shaft 5 as shown in FIG. 6 so as to form a space for removing a jammed paper. Further, the upper surface of the cross plate 22L projecting inward from the lower edge of the outer plate 21 functions as a fan-fold paper guide surface. This upper surface of the cross plate 22L will hereinafter be referred to as the "paper guide surface 22L."

This paper guide surfaces 22L and 22R is arranged one step lower than a paper guide surface 14 on the fixed paper guide member 13, thereby preventing the paper guide surfaces 22L and 22R from strongly contacting the fan-fold paper when the fan-fold paper fed into the paper engage guide section of the movable paper guide members 20L and 20R is convex curved face-up by the paper guide surface 14. Thus, the fan-fold paper can easily pivot on the paper guide surface 14 when the fan-fold paper is aligned by engaging the left hand movable paper guide member 20L. Further, by bending the fan-fold paper to form the above mentioned convex at the edge of the paper guide surface 14, the fan-fold paper can be fed into the engaging section without any slack.

Figure 1:
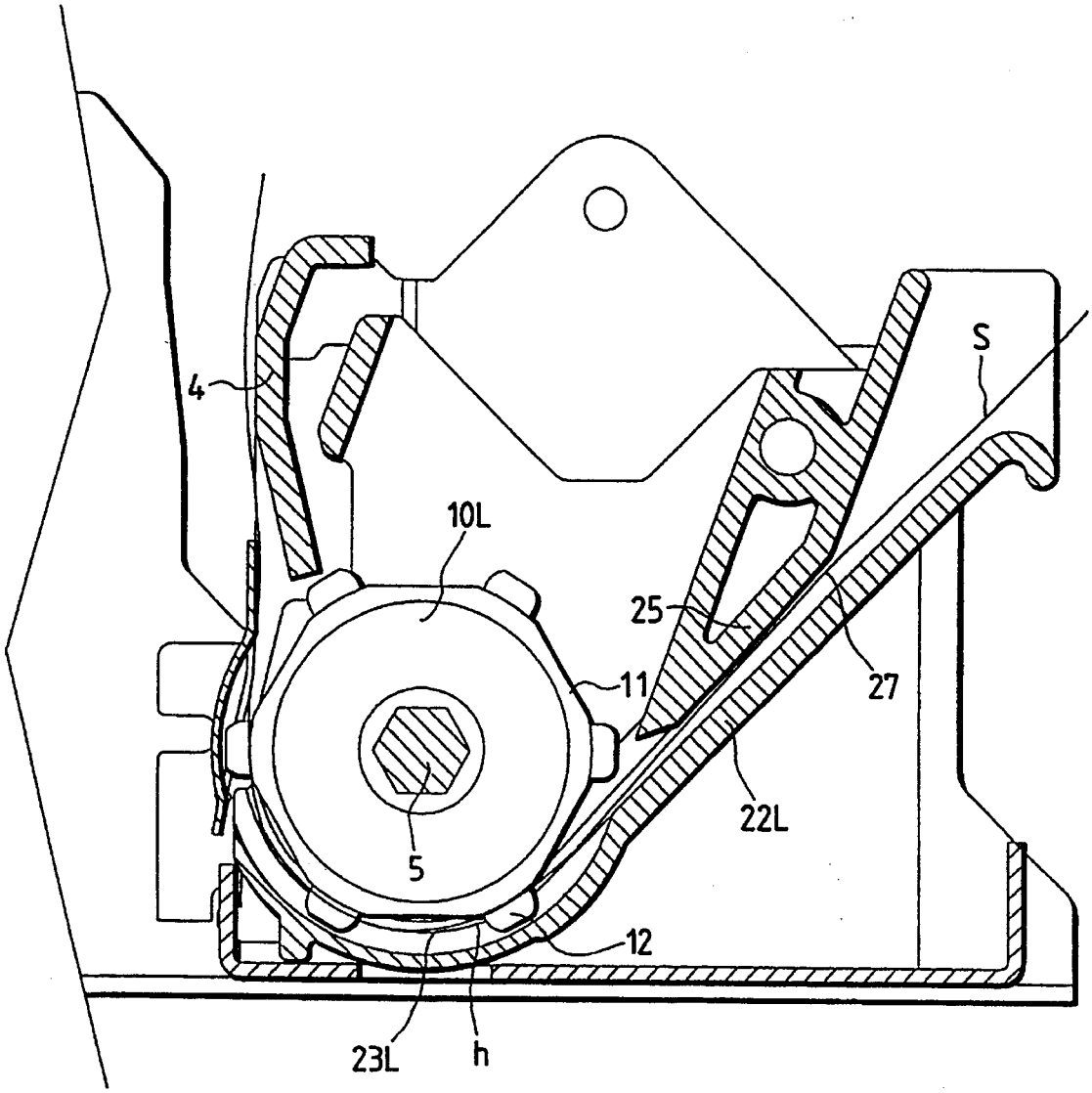
FIG. 1 is a sectional view showing a main portion of a paper transfer apparatus, which is an embodiment of the invention, from one side.

On the other hand, the left hand paper guide surface 22L of the movable paper guide member 20L directly extends toward a circumferential surface 11 of the corresponding sprocket wheel 10L in the form of a straight line while forming a narrow slit 27L together with the upper cross plate 25 (the cross plate 25 arranged at the lower edge of the inner plate 24) as shown in FIG. 1. An end of the paper guide surface 22L forms an arcuate surface 23L that enters into the locus of the tip of a pin 12 of the sprocket wheel 10L, so that the pin 12 of the sprocket wheel 10L can be engaged with the corresponding sprocket hole h of the fan-fold paper guided by the guide surface 22L at the arcuate surface 23L. The area where the fan-fold paper engages with the sprocket wheel 10L is referred to as a sprocket engage guide section.

Figure 2:
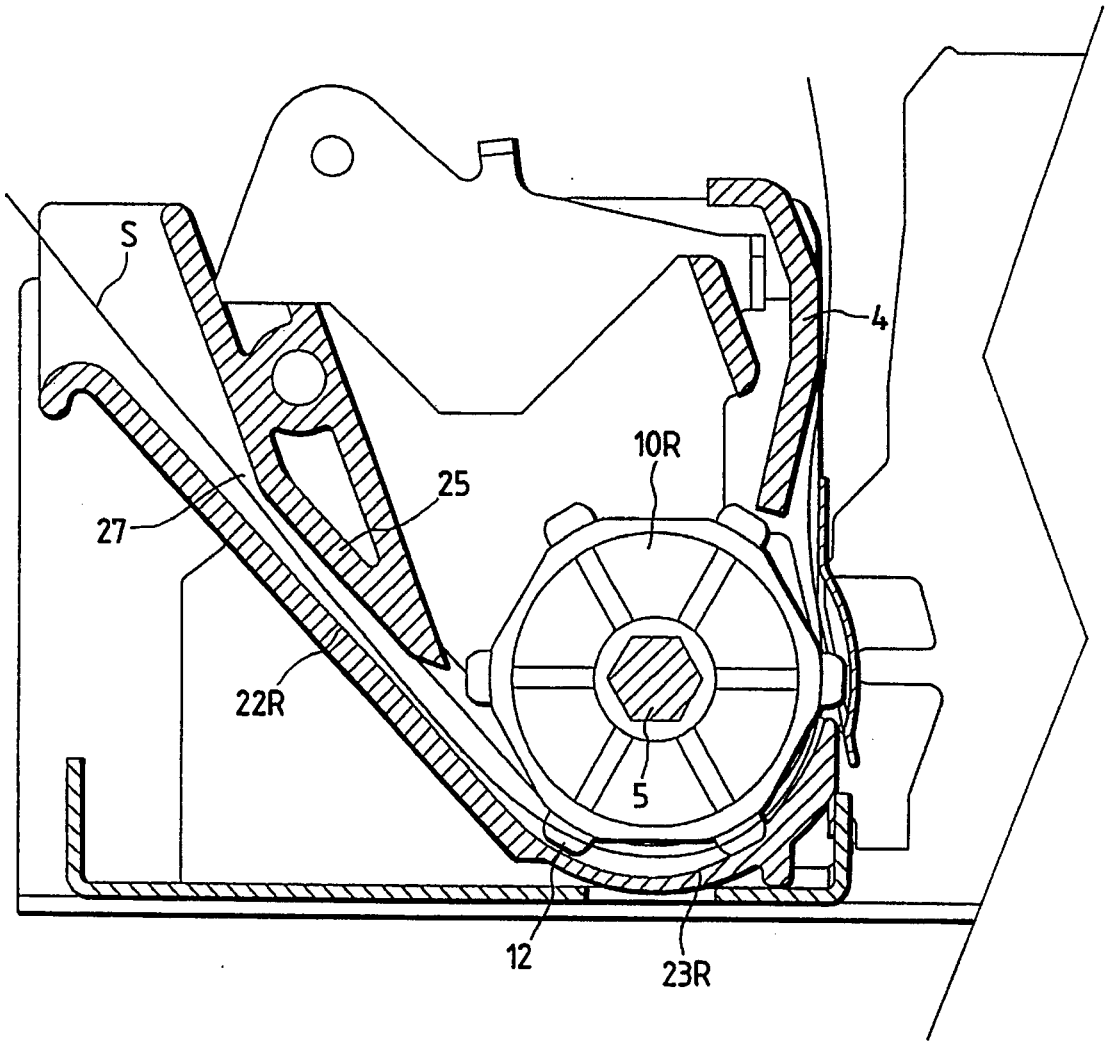
FIG. 2 is a sectional view showing a main portion of the same paper transfer apparatus from another side.
Figure 3:
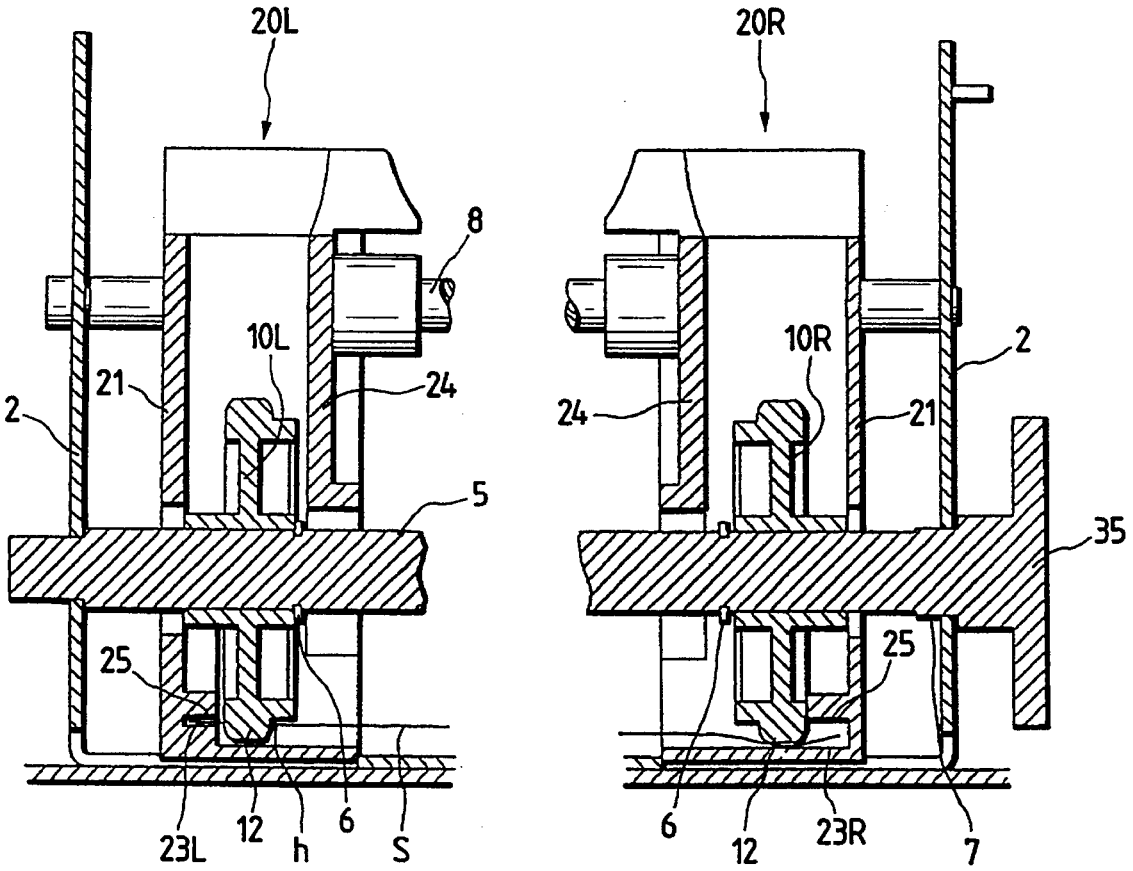
FIG. 3 is a front cross-sectional view showing a main portion of the same paper transfer apparatus.

Further, as shown in FIG. 2, the right hand paper guide surface 22R extends toward the circumferential surface of the locus of the tip of a pin 12 of the corresponding sprocket wheel 10R while forming a wider slit 27R together with the upper cross plate 25. An end of the paper guide surface 22R forms an arcuate surface 23R that enters into the locus of the tip of the pin 12 from the outer circumference of the locus. In other words, the length of paper path of the arcuate surface 23R leading to the engage guide section is longer than that of the arcuate surface 23L, thus enabling the right hand sprocket wheel 10R to be engaged with the fan-fold paper after the left hand sprocket wheel 10L has been engaged with corresponding sprocket holes h of and aligned the fan-fold paper.

Figure 4:
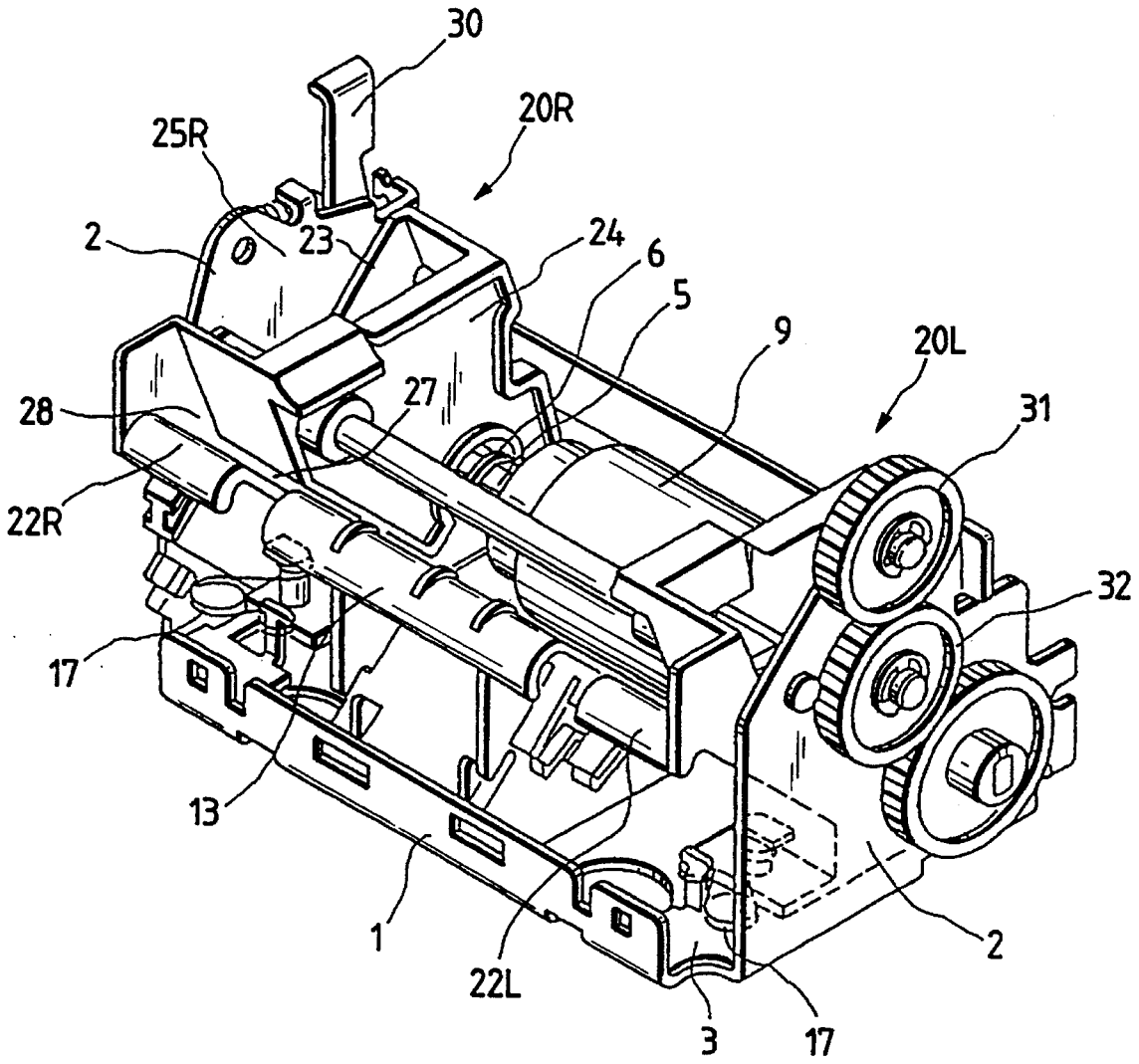
FIG. 4 is a perspective view showing the same paper transfer apparatus from a paper insertion inlet side.

It should be noted that reference numeral 30 in FIG. 4 denotes a manually operating lever that interrupts transmission of the drive force from the stepping motor to the paper transfer shaft 5, and that reference numeral 31 denotes a manually operating gear that rotates the paper transfer shaft 5 manually through an intermediate gear 32.

The operation of transferring the fan-fold paper by the thus constructed paper transfer apparatus will be described below.

First, the movable paper guide members 20L, 20R on the left and right sides are moved inward or outward in accordance with the width of a fan-fold paper to be set.

In this case, the movable paper guide members 20L, 20R are stably held after being positioned to a predetermined paper width position by the toggling operation of the bistable springs 17, 17, each of which switches its urging direction from one stable position to the other at the balanced point. Then, the leading end of the fan-fold paper is fed into the sprocket wheels 10L, 10R from above in the rear with the paper extending not only along the fixed paper guide surface 14 in the middle, which is one step higher but also along the paper guide surfaces 25 on the left and right sides.

Therefore, the fan-fold paper is placed without any slack with the convex side facing-up on by the fixed paper guide surface 14 in the middle and with both sides thereof guided by the slits 27L, 27R of the movable paper guide members 20L, 20R formed by paper guide surfaces 22L and 22R and the upper cross plate 25. Further, as shown in FIG. 1, the left side of the fan-fold paper comes in contact with the circumferential surface 11 of the sprocket wheel 10L while guided by the paper guide surface 22L that extends toward the circumferential surface 11 of the sprocket wheel 10L, and the left side sprocket hole h of the fan-fold paper is engaged with the pin 12 by the subsequent transferring operation at an initial stage of the passage of the paper along the arcuate surface 23L.

Therefore, if the fan-fold paper is inserted obliquely, the right side sprocket hole h in FIG. 2 is not engaged with the pin 12, but is guided to the arcuate surface 23R extending along the outer circumference of the locus of the tip of the pin 12 directly without causing any jam. When the left side sprocket hole h of FIG. 1 is engaged with the pin 12 so that the fan-fold paper is further fed, the fan-fold paper is then guided into the inner surface of the outer plate 21 to have the obliqueness rectified, which in turn causes the right side sprocket hole h to confront the corresponding pin 12. As the fan-fold paper is further fed by the subsequent transferring operation, the right side of the fan-fold paper is guided into the rear end of the arcuate surface 23R so as to allow the right side to enter into the locus of the pin 12, which in turn allows the right hand sprocket hole h to be engaged with the pin 12 smoothly. As a result of this engagement, the fan-fold paper can be fed correctly by the sprocket wheels 10L, 10R on the left and right sides.

Further, should a jam occur right at these positions during this paper transferring process, and if the fan-fold paper engaged with the pins 12 remains at the sprocket wheels 10, then such remaining paper can be removed from spaces formed between the largely notched upper cross plates 26 in the vicinities of the paper transfer shaft 5 and the arcuate surfaces 23.

By the way, the foregoing describes the paper transferring operation in the case where the fan-fold paper is set to the paper transfer apparatus. In the case of using a roll paper, the sprocket wheels 10L, 10R are removed from both ends of the paper transfer shaft 5, and then a driven roller 34 is brought into pressure contact with the guide roller 9 as shown in FIG. 5 so that the roll paper can be transferred therebetween. In this case, the paper detection sensor arm 16 disposed at the position where the roll paper comes into contact with the guide roller 9 detects the paper, causing the guide roller to start rotation.

The present invention can be effective as long as the sprocket hole on one side is first engaged with the pin 12 of the sprocket wheel 10 and the sprocket hole on the other side is then engaged with the corresponding pin 12. Accordingly, it is not necessary to mount the both left and right sprocket wheels on the common paper transfer shaft 5. It is possible to arrange a shaft of a sprocket wheel, whose engagement comes later, on the downstream of the other sprocket wheel shaft in the paper transfer direction.

As described in the foregoing, the paper transfer apparatus of the invention comprises a first paper guide means for forming a paper transferring path having a first intersection with a rotational locus of the tip of the sprocket pins mounted on a first sprocket wheel and second paper guide means for forming a paper transferring path having a second intersection with a rotational locus of the tip of the sprocket pins mounted on a second sprocket wheel, the first intersection being placed upstream in a paper transferring direction from the second intersection. Therefore, even if the continuous paper is inserted obliquely, such obliqueness can be rectified by engaging sprocket holes on one side of the continuous paper with pins of a sprocket wheel, and sprocket holes on the other side are thereafter engaged with pins of the other sprocket wheel. That is, the continuous paper can be engaged with the sprocket wheels smoothly and reliably without forcing nor causing jams by sequentially causing the pins of the sprocket wheels to be engaged with the sprocket holes on one side after another.

What is claimed is:

1. A paper transfer apparatus for transferring a recording paper by rotating first and second sprocket wheels having a plurality of pins to be engaged with sprocket holes disposed on both sides of the recording paper comprising:

a first paper guide means for forming a first paper transfer path extending in a paper transfer direction, said first transfer path having a first intersection with a rotational locus of the tip of the pins mounted on said first sprocket wheel, and a second paper guide means for forming a second paper transfer path extending in said paper transfer direction, said second transfer path having a second intersection with a rotational locus of the tip of the pins mounted on said second sprocket wheel, said first intersection being placed upstream in said paper transfer direction from said second intersection.

2. A paper transfer apparatus of claim 1, wherein said first paper guide means comprises a recording paper edge guide section for aligning the recording paper.

3. A paper transfer apparatus of claim 2, wherein at least one of said first and second paper guide means is mounted movably in a width direction of the recording paper.

4. A paper transfer apparatus as defined in claim 3 further comprising:

a paper transfer shaft on which said first and second sprocket wheels are slidably mounted, said paper transfer shaft including a stopper ring for limiting the lateral movement in an inward direction of said first paper guide means, and a larger-diameter portion for limiting the lateral movement in an outward direction of said second paper guide means.

5. A paper transfer apparatus of claim 1, wherein said first and second paper guide means have a first and second sprocket engage guide section, respectively, forming a first and second arcuate section having nearly the same center as the corresponding sprocket wheel;

said first sprocket engage guide section comprising:

a first paper engage section being smaller in diameter than a rotational locus of the tip of the pins of the first sprocket wheel, and said second sprocket engage guide section comprising:

a second paper engage section downstream in the paper transfer direction from said first paper engage section being larger in diameter than the rotational locus of the tip of the pins of the second sprocket wheel.

6. A paper transfer apparatus of claim 5 further comprising:

a first detection means for detecting insertion of the recording paper; and a second detection means for confirming an alignment of said recording paper;

said first detection means being disposed near to said first intersection, and said second detection means being disposed near to said second intersection.

7. A paper transfer apparatus of claim 5, wherein said first and second paper guide means have an individual opening for exposing the engagement of the recording paper with said pins opposite said corresponding sprocket engage guide section of said corresponding sprocket wheel.

8. A paper transfer apparatus of claim 5 further comprising:

a third paper guide means disposed between said first and second paper guide means, said third paper guide means making the recording paper form a convex curve at a position upstream in said paper transfer direction from a sprocket engage guide sections of said first and second paper guide means.

9. A paper transfer apparatus of claim 8 further comprising:

a first detection means for detecting insertion of the recording paper; and a second detection means for confirming an alignment of said recording paper;

said first detection means being disposed near to said first intersection, and said second detection means being disposed near to said second intersection.

10. A paper transfer apparatus as defined in claim 8 wherein said first and second paper guide means are positioned lower than said third paper guide means.

11. A paper transfer apparatus of claim 1, wherein shafts of said first and second sprocket wheels are disposed in different rotational axes.

12. A paper transfer apparatus of claim 1 further comprising:

a third paper guide means disposed between said first and second paper guide means, said third paper guide means making the recording paper form a convex curve at a position upstream in a paper transfer direction from a sprocket engage guide section of said first and second paper guide means.

13. A paper transfer apparatus of claim 12 further comprising:

a first detection means for detecting insertion of the recording paper; and a second detection means for confirming an alignment of said recording paper;

said first detection means being disposed near to said first intersection, and said second detection means being disposed near to said second intersection.

14. A paper transfer apparatus of claim 12, wherein shafts of said first and second sprocket wheels are disposed in different rotational axes.

15. A paper transfer apparatus of claim 13, wherein shafts of said first and second sprocket wheels are disposed in different rotational axes.

16. A paper transfer apparatus of claim 1 further comprising:

a first detection means for detecting insertion of the recording paper; and a second detection means for confirming an alignment of said recording paper;

said first detection means being disposed near to said first intersection, and said second detection means being disposed near to said second intersection.

17. A paper transfer apparatus of claim 16, wherein shafts of said first and second sprocket wheels are disposed in different rotational axes.

18. A printer comprising a paper transfer apparatus for transferring a recording paper by rotating first and second sprocket wheels having a plurality of pins to be engaged with sprocket holes disposed on both sides of the recording paper comprising:

a first paper guide surface for forming a first paper transfer path extending in a paper transfer direction, said first transfer path having a first intersection with a rotational locus of the tip of the pins mounted on said first sprocket wheel, and a second paper guide means for forming a second paper transfer path extending in said paper transfer direction, said second transfer path having a second intersection with a rotational locus of the tip of the pins mounted on said second sprocket wheel, said first intersection being placed upstream in said paper transfer direction from said second intersection.

* * * * *